United States Patent [19]

Hernandez

[11] 4,017,921

[45] Apr. 19, 1977

[54] COOLING BLANKET

[76] Inventor: Carmen T. Hernandez, 201 E. 17th St., New York, N.Y. 10003

[22] Filed: Jan. 30, 1975

[21] Appl. No.: 545,578

[52] U.S. Cl. ..... 5/347; 5/368

[51] Int. Cl.[2] ..... A47G 23/00

[58] Field of Search ..... 5/347, 348 A, 349, 350, 5/368, 370, 371

[56] References Cited

UNITED STATES PATENTS

| | | | |
|---|---|---|---|
| 254,265 | 2/1882 | Bone | 5/349 |
| 505,873 | 10/1893 | Bomgardner | 5/348 X |
| 779,576 | 1/1905 | Berryman | 5/349 |
| 2,093,834 | 9/1937 | Gaugler | 5/347 |
| 2,110,022 | 3/1938 | Kliesrath | 5/347 X |
| 3,678,520 | 7/1972 | Evans | 5/348 R |

*Primary Examiner*—Paul R. Gilliam
*Assistant Examiner*—Andrew M. Calvert
*Attorney, Agent, or Firm*—Jack D. Slobod

[57] ABSTRACT

A blanket is provided for producing a cooling effect as opposed to a conventional blanket which retains heat is provided. The blanket has a plurality of elongated chambers defined normally by a plurality of elongated joints between blanket lamina. The chambers are adapted for receiving ice.

1 Claim, 3 Drawing Figures

COOLING BLANKET

BACKGROUND OF THE INVENTION

The invention relates to bedcoverings and particularly to blankets adapted for cooling a person disposed proximate to the blanket. The prior art includes apparatus having a very general similarity to the apparatus of the present invention. United States Patents showing such apparatus include: Kucher, U.S. Pat. No. 2,096,553; Williams, U.S. Pat. No. 2,512,559; Gaugler, U.S. Pat. No. 2,104,587; and 2,093,834; and Kliesrath, U.S. Pat. No. 2,110,022. The apparatus in general has been relatively complex and often involves the requirement for large cylinders of compressed gases or vapor cycle refrigeration systems including condensors and evaporators. Such apparatus is not only expensive to purchase, but also expensive to maintain. The expense involved in purchase of such apparatus is particularly significant since for many the requirements for cooling exist only during a relatively short summer season. It will be understood that the apparatus in accordance with the invention will have application not only to various medical situations requiring cooling of the patient, but also to domestic uses where it will be desirable to place the blanket in accordance with the invention underneath the person to be cooled. It will be understood that the use in this latter manner will produce a substantial cooling of the individual disposed thereon without the necessity for cooling an entire room which would require the use of very expensive air conditioning apparatus as well as substantially greater energy than is necessary to freeze the relatively small quantity of ice required in accordance with the invention.

It is a primary object of the invention to provide a blanket for cooling an individual disposed proximate thereto which is simple and inexpensive to manufacture and requires a minimum of maintenance and which is safe for the individual using the apparatus.

SUMMARY OF THE INVENTION

A flexible member having defined therein a plurality of elongated chambers having walls that are flexible and waterproof and that are each provided with means for selective access to the interior thereof.

In one form the blanket is manufactured of flexible lamina which are selectively joined along elongated joints extending in a common direction. The laminar material may be a plastic, rubber, or other waterproof material.

BRIEF DESCRIPTION OF THE DRAWING

The invention will be better understood by reference to the accompanying drawing in which.

DESCRIPTION OF THE PREFERRED EMBODIMENT

Figure 1:
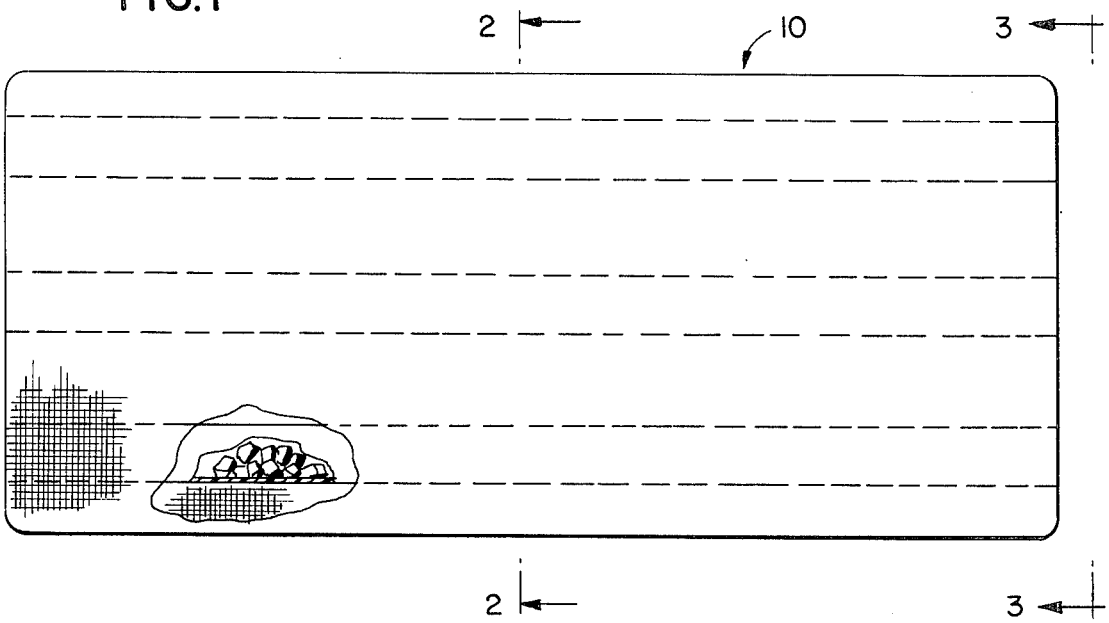
FIG. 1 is a plan view of the apparatus in accordance with the invention.
Figure 2:
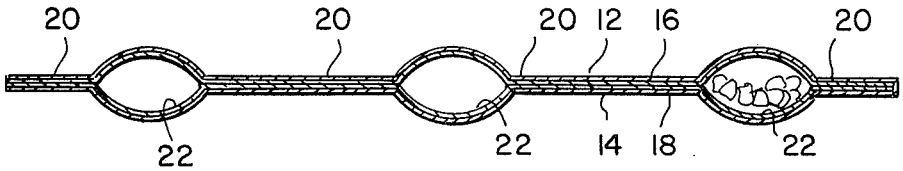
FIG. 2 is a sectional view taken through the line 2—2 of FIG. 1.
Figure 3:
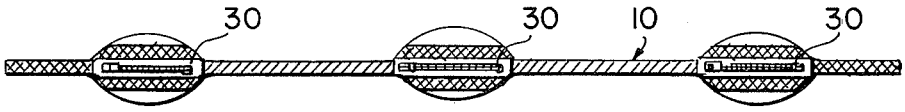
FIG. 3 is an end elevational view of the apparatus shown in FIG. 1.

Referring now to FIGS. 1, 2 and 3 there is shown a laminar blanket 10 which in the preferred form is included cloth facing 12, 14 which may be cotton in one form. In other forms of the invention the cloth facing may be nylon or wool. Disposed intermediate the facing 12, 14 are laminations 16, 18 which are waterproof and ordinarily will be plastic or rubber. The laminations 16, 18 are joined in a plurality waterproof elongated joints 20 extending normally throughout the length of the blanket 10. The joints 20 defines a plurality of elongated chambers 22 which extend in the preferred form for the length of the blanket 10. Disposed at one end of each chamber 22 is a closure member 30 which may be a zipper which has been modified to provide fluid sealing by means of plastic or rubber disposed about the cooperating fingers thereof. The opposite end of each chamber is sealed by joining the laminar 16, 18 together (not shown). The joining of the laminar 16, 18 may be accomplished in various ways which in part will depend on the material chosen. The method of joining may include the application of heat which is particularly desirable in those applications where thermoplastic materials are used and sonic joining metods. In some applications it may also be desirable to cement the laminar together.

Having thus described my invention, I claim:

1. A blanket adapted to receive ice; said blanket comprising : a pair of elongated sheets of water impervious material; said sheets being substantially congruent and being disposed adjoining each other as layers, said sheets being sealably adhered to each other along a plurality of spaced apart parallel elongated strip regions running the length of said sheets in a manner that a plurality of parallel elongated chambers between said sheets and running the length of said sheets are defined in alternating relationship with said elongated strip regions; a plurality of zipper closure members respectively located at one end of said plurality of chambers for allowing said chambers to be filled with ice; and a facing material permanently adhered over said sheets.

* * * * *